US007627278B2

(12) United States Patent
Nakagawa et al.

(10) Patent No.: US 7,627,278 B2
(45) Date of Patent: Dec. 1, 2009

(54) IMAGE HEATING APPARATUS WITH PADS AND URGING MEANS CONTACTING THE PADS AND A STEP BETWEEN PAD CONTACTING SURFACES

(75) Inventors: Tomohito Nakagawa, Abiko (JP); Tetsuro Awaya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/430,991

(22) Filed: May 10, 2006

(65) Prior Publication Data

US 2006/0257180 A1 Nov. 16, 2006

(30) Foreign Application Priority Data

May 16, 2005 (JP) ..... 2005/142419

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS 5,614,999 A 3/1997 Kanesawa et al. ..... 399/329
5,999,788 A * 12/1999 Kanesawa et al. ..... 399/329
6,411,785 B1 * 6/2002 Ogawahara et al. ..... 399/69
6,650,863 B2 * 11/2003 Fuma ..... 399/329

FOREIGN PATENT DOCUMENTS

JP 10228195 A * 8/1998
JP 2001-318544 11/2001
JP 2002-148985 5/2002
JP 2002148971 A * 5/2002
JP 2004012682 A * 1/2004

OTHER PUBLICATIONS

Translation of Chinese Notification of the First Office Action in Chinese Patent Application No. 200610082427, dated Feb. 15, 2008. Second Office Action in Chinese Patent Application No. 200610082427.6 dated Oct. 17, 2008, with translation.

* cited by examiner

*Primary Examiner*—Quana M Grainger
(74) *Attorney, Agent, or Firm*—Fitzpatrick, Cella, Harper & Scinto

(57) ABSTRACT

An image heating apparatus includes a heating rotatable member for heating an image on a recording material at a nip; a belt cooperative with the heating rotatable member to form the nip; an elastic pad and a rigid pad, disposed in the order named along a feeding direction for the recording material, for pressing the belt toward the heating rotatable member at the nip; and urging means for urging the elastic pad and the rigid pad toward the belt, wherein the urging means contacts the rigid pad to the belt earlier than the elastic pad.

3 Claims, 9 Drawing Sheets

IMAGE HEATING APPARATUS WITH PADS AND URGING MEANS CONTACTING THE PADS AND A STEP BETWEEN PAD CONTACTING SURFACES

FIELD OF THE INVENTION AND RELATED ART

The present invention relates to an image heating apparatus employed by an image forming apparatus such as a copying machine, a printer, etc.

In the field of an image forming apparatus such as an electrophotographic copying machine, a laser beam printer, etc., which is for forming an image, it has been common practice to obtain a fixed image by forming a toner image on the top surface of a recording medium, and then, thermally fixing this toner image to the recording medium. As a fixing means used for above described purpose, there has been available a fixing unit structured to fix an image to a recording medium while conveying the recording medium, convey the recording medium to which the image has just been fixed, and discharge the recording medium into an external delivery tray so that it is laid on top of the recording mediums having accumulated therein.

Japanese Laid-open Patent Application 2001-318544 for example, discloses a fixing apparatus which comprises a fixing roller, a fixing pad, and a pressure application belt. The fixing apparatus is structured so that the pressure application belt is kept pressed against the fixing roller by the pressure application pad which presses on the rear surface of the pressure application belt. As for its fixing operation, while a recording sheet, on which toner (toner image) is present, is moved through the fixing area, that is, the interface effected by the pressing of the pressure application belt against the fixing roller by the fixing pad, the toner (toner image) is fixed. Generally, a fixing apparatus such as the above described one is structured so that it can switched in operational mode with the use of a lever; it can be put in the normal mode, that is, the pressure application mode, or the no pressure mode. The no pressure mode is the mode for making it easier for a user to remove the jammed paper. Obviously, it is used if a paper jam or the like occurs. More specifically, if a paper jam or the like occurs, a user is to remove the pressure by operating the lever, remove the jammed paper, and then, return the lever to the normal position to put the fixing apparatus back into the original mode, or the pressure application mode.

However, a fixing apparatus such as the above described one, which is based on the prior art, suffers from the following problem. That is, referring to FIG. 8, when a user switches the fixing apparatus in operational mode by operating the unshown lever, from the mode in which the endless belt 118 is not under pressure, to the mode in which the endless belt 118 is under pressure, the fixing pad 113 presses the endless belt 118 toward the fixing roller 112 from inward side of the loop which the endless belt 118 forms. As a result, the fixing pad 113 first presses the endless belt 118 against the fixing roller 112, generating pressure at the belt contacting surface 113*a*, and then, the high rigidity pad 115 presses the endless belt 118 against the fixing roller 112, generating higher pressure than the pressure generated by the fixing pad 113.

Therefore, the leading edge portion 113*b* of the fixing pad 113, which is located very close to the high rigidity pad 115, is pinched between the high rigidity pad 115 and endless belt 118 and is pressed while remaining pinched between the high rigidity pad 115 and endless belt 118, sometimes preventing the belt contacting surface 115*a* of the high rigidity pad 115, which is expected to come into contact with the endless belt 118 and press the endless belt 118 against the fixing roller 112, from pressing the endless belt 118 against the fixing roller 112.

If the belt contacting surface 115*a* of the high rigidity pad 115 is prevented from pressing the endless belt 118 against the fixing roller 112, it is impossible for a desired fixing nip to be formed. If the desired fixing nip is not formed, fixation failure occurs. Further, if the belt contacting surface 115*a* is prevented from pressing the endless belt 118 against the fixing roller 112, the high pressure portion of the desired fixing nip is not formed. Without the high pressure portion, the recording sheet, on which toner is borne, fails to separate from the fixing roller 112, wrapping itself around the fixing roller 112. These are the problems which an image heating apparatus based on the prior art suffers.

FIG. 9 is a graph showing the pressure distribution in the fixing nip. The axis of abscissas of the graph represents the position in the fixing nip in terms of the direction in which recording medium is conveyed, and the axis of ordinates represents the pressure in the fixing nip. The solid line represents the ideal pressure distribution pattern, in which the internal pressure of the fixing nip continuously increases from the entrance of the fixing nip, at which the internal pressure is P1 (low pressure), toward the exit of the fixing nip, at which the internal pressure is P2 (high pressure). It should be noted here that P2 is the amount of pressure necessary to make the recording sheet to separate from the fixing roller 112; the high rigidity pad 115 causes the rubber layer of the fixing roller 112 to partially deform, causing thereby the recording sheet to separate from the fixing roller 112. The double-dot chain line in FIG. 9 represents the pressure distribution in the fixing nip, which occurs when the leading edge portion 113*b* of the fixing pad 113 remains pinched between the endless belt 118 and high rigidity pad 115. In this case, the high rigidity pad 115 does not press the endless belt 118 against the fixing roller 112, failing to generate P2, which is necessary to make the recording medium to separate from the fixing roller 112. Further, with the high rigidity pad 115 prevented from pressing the endless belt 118 against the fixing roller 112, the resultant fixing nip will be narrower than the desired fixing nip, failing to supply the recording medium with the amount of heat necessary for fixation. Therefore, it is possible that fixation failure will occur.

SUMMARY OF THE INVENTION

The primary object of the present invention is to provide an image heating apparatus which does not suffer from the image heating deficiency attributable to the formation of an unsatisfactory nip.

Another object of the present invention is to provide an image heating apparatus, the elastic pad of which is not pinched between its rotational heating member and rigid pad.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiment of the present invention will be described with reference to the appended drawings. Incidentally, the measurements, materials, and shapes of the structural components, and the positional relationship among the components, which will be described hereafter, are not intended to limit the scope of the present invention, unless specifically noted. Further, if a given component is identical in material, shape, etc., to another component which has already been described, it will not be described, unless specifically noted.

(Image Forming Apparatus)

Figure 2:
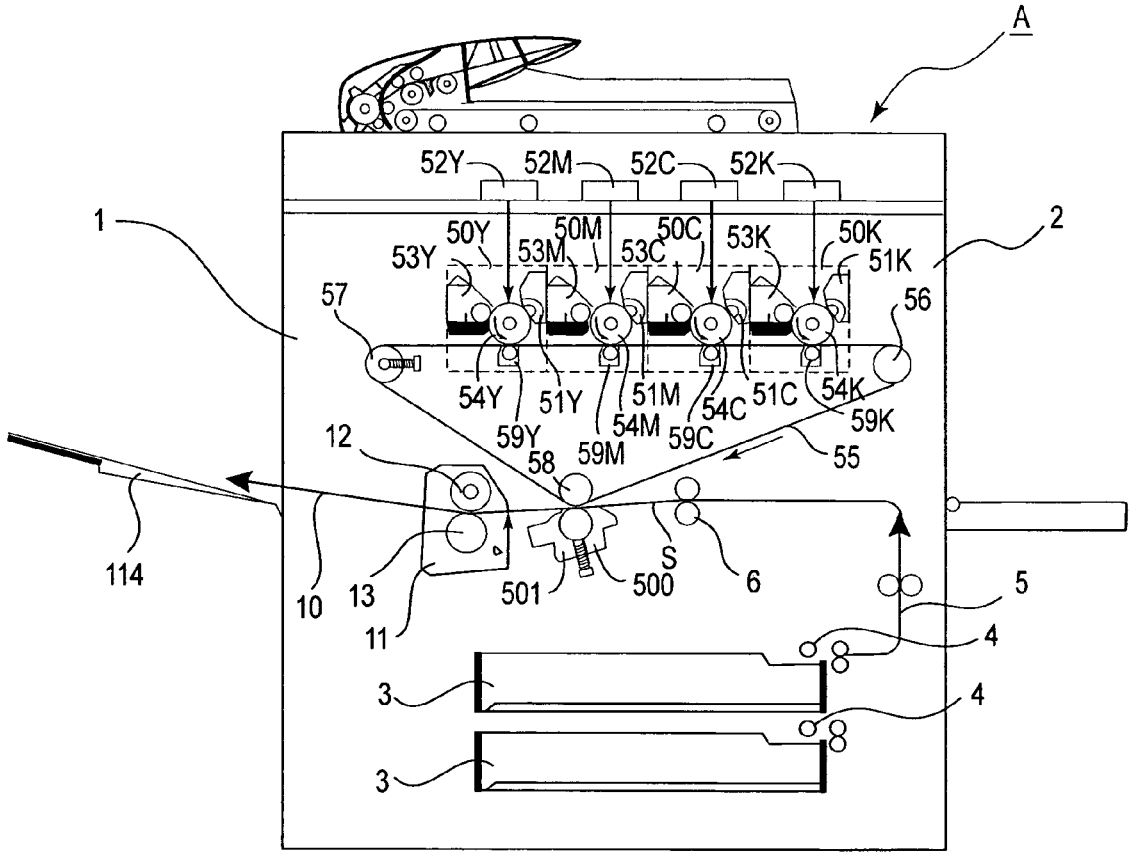
FIG. 2 is a sectional view of the image forming apparatus in the preferred embodiment of the present invention.

First, an example of a preferable image forming apparatus compatible with an image heating apparatus in accordance with the present invention will be described. FIG. 2 is a sectional view of the image forming apparatus in the preferred embodiment of the present invention, showing the general structure of the apparatus.

The image forming apparatus A in this embodiment is an electrophotographic printer (copying machine). Designated by a referential symbol 1 is the main assembly of the image forming apparatus, and designated by a referential symbol 2 is an electrophotographic image forming portion (which hereinafter will be referred to as image forming portion). Designated by a referential symbol 3 is a sheet (recording medium) cassette, as a sheet feeding and conveying portion (which hereinafter will be referred to as cassette). The mechanism of this image forming portion for carrying out the image formation process is the same as the publicly known mechanism of an image forming portion. Therefore, its structure is illustrated in a simplified form.

The image forming portion 2 carries out an image forming operation based on the image formation information and the print start signal, which are inputted into the control portion (unshown) of the apparatus main assembly 1 from a host apparatus (unshown) such as a computer. As the image forming operation is started, the feeder/conveyer roller 4 of the sheet feeding-and-conveying portion is driven with preset control timing. As a result, recording mediums S are fed from the cassette 3 into the apparatus main assembly 1, while being separated one by one, and is conveyed further into the main assembly 1, being guided upward by a conveyance path 5. Then, each recording medium S is introduced into the image transferring portion of the image forming portion 2 by a pair of registration rollers with a preset timing. In the image transferring portion, a toner image is transferred onto the recording medium 2. The image transferring portion will be described later.

The image forming portion 2 is of the tandem type, and employs an intermediary transfer belt. More specifically, the image forming portion 2 is made up of multiple image forming portions 50Y, 50M, 50C, and 50K, which are aligned in parallel and form monochromatic toner images different in color, one for one. Here, Y, M, C, and K stand for yellow, magenta, cyan, and black colors, respectively.

The image forming portions 50Y-50K have charging apparatuses 51Y, 51M, 51C, and 51K, exposing apparatuses 52Y, 52M, 52C, and 52K, developing apparatuses 53Y, 53M, 53C, and 53K, and photosensitive members 54Y, 54M, 54C, and 54K, respectively. The intermediary transfer belt 55 is stretched around a driver roller 56, a tension roller 57, and a secondary transfer roller 58, and is suspended by the rollers. The secondary roller 58 is disposed on the inward side of the loop which the intermediary transfer belt 55 forms. The intermediary transfer belt 55 circularly moves in the direction indicated by an arrow mark in the drawing. As the intermediary transfer belt 55 moves, the monochromatic toner images different in color are sequentially transferred in layers onto the intermediary transfer belt 55 by the primary image transferring apparatuses 59Y, 59M, 59C, and 59K. Incidentally, FIG. 2 shows an image forming apparatus, in which the image forming portions for forming the monochromatic toner images are positioned in the order of Y, M, C, and K. However, the order of the image forming portions does not need to be limited to the abovementioned one.

The multiple monochromatic color toner images on the intermediary transfer belt 55 are transferred all at once by a secondary image transferring apparatus 500 onto the recording medium S delivered thereto from a recording medium feeding portion. The secondary transferring apparatus 500 has a secondary transfer roller 501, which is on the outward side of the intermediary transfer belt loop, and forms a transfer nip by being pressed against the secondary transfer roller 58, which is on the inward side of the belt loop. In each transfer nip, the toner image is electrostatically adhered to the recording medium S.

After the reception of all the toner images by the recording medium S, the recording medium S is introduced into the fixing nip, which is the compression nip between a fixing roller (rotational heating member) 12 and a pressure application unit 13. Then, as the recording medium S is conveyed through the fixing nip while remaining pinched by the fixing roller 12 and pressure application unit 13, the toner images are permanently fixed to the recording medium S by the heat from the fixing roller 12 and the pressure in the fixing nip; the toner images on the recording medium S are turned into a single permanent image.

After coming out of the fixing nip, the recording medium S is guided by a discharge path 10 into an external delivery tray 114, and accumulated therein. Incidentally, the guides and the like which make up the recording medium conveyance paths are not shown in the drawings to prevent the drawings from becoming complicated.

Embodiment

Figure 1:
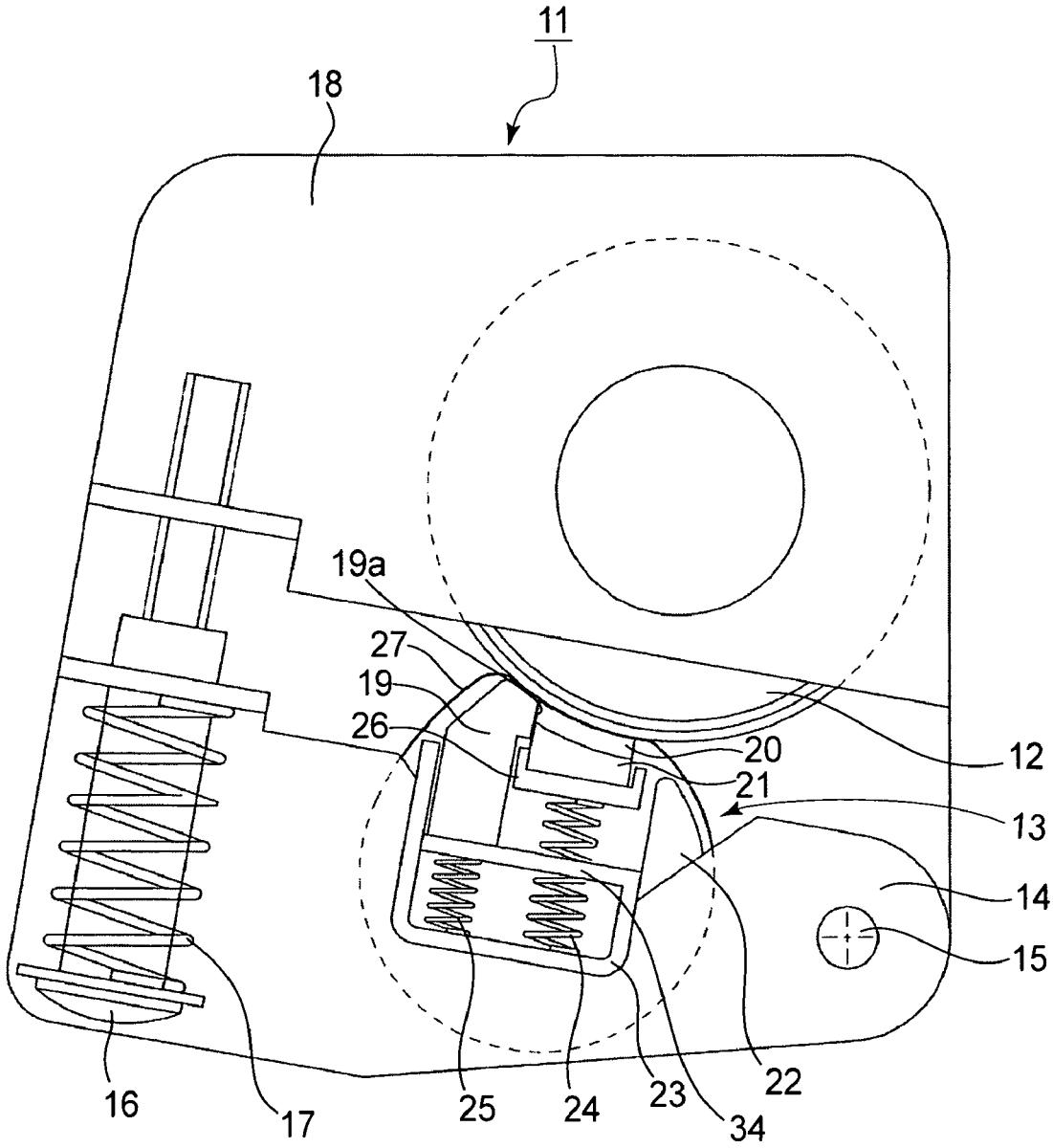
FIG. 1 is a sectional view of the fixing unit in one of the preferred embodiments of the present invention.

Next, the fixing unit 11 as one of the examples of an image heating apparatus in accordance with the present invention will be described. FIG. 1 is a sectional view of the fixing unit in this embodiment.

The fixing unit 11 has a frame 18, which supports the fixing roller 12 by its axle. The fixing roller 12 is a rotational heating member, which is heated by an unshown heater. The fixing roller 12 is pressed by the pressure application unit 13, forming a fixing nip between itself and the pressure application unit 13. In this fixing nip, the toner images on the recording medium S are subjected to heat and pressure. As a result, the toner images are fixed to the recording medium S.

The pressure application unit 13 has a stay 23 (pressing means), which is a supporting member (supporting plate). The stay 23 is roughly U-shaped in cross-section, and extends in the direction parallel to the rotational axis of the fixing roller 12. The stay 23 supports a high rigidity block 19 and a fixing pad 20. The high rigidity block 19 functions as the high rigidity pad for forming the high pressure portion of the fixing nip, which constitutes the downstream end portion of the fixing nip in terms of the recording medium conveyance direction, whereas the fixing pad 20 is an elastic pad for forming the low pressure portion of the fixing nip, which is the upstream portion of the fixing nip. In other words, the fixing nip is made up of the low pressure portion effected by the elastic pad, and the high pressure portion effected by the rigid pad.

The pressure application unit 13 has a member 34, which was welded to the stay 23 in a manner to cover the open side of the stay 23. The stay 23 is formed by bending a flat piece of metallic plate so that the resultant product has a roughly U-shaped cross section. The stay 23 constitutes the backbone of the pressure application unit 13.

The pressure application unit 13 also has an endless belt 27 (which hereafter will be referred to as belt), which is fitted around the aforementioned stay 23. The pressure application unit 13 is structured so that the endless belt 27 is rotated by the rotation of the fixing roller 12. The pressure application unit 13 is provided with a pair of belt guides 22 and 33 (FIG. 3), which are disposed on the inward side of the belt loop to ensure that the belt 27 smoothly rotates. Also disposed on the inward side of the belt loop is a piece of felt (unshown) impregnated with silicon oil, as lubricant, to be supplied to the inward surface of the belt 27 to improve the belt 27 in terms of the slipperiness relative to the block 19 and fixing pad 20.

Further, the pressure application unit 13 is provided with multiple compression springs 24 as pressure applying means, which are aligned in parallel in the lengthwise direction (which is direction parallel to the rotational axis of fixing roller). The compression springs 24 keeps the fixing pad 20 pressured toward the belt 27, causing the fixing pad 20 to form the low pressure portion of the fixing nip, which will be described later.

Further, the pressure application unit 13 is provided with multiple compression springs 25 for keeping the block 19 pressured toward the belt 27. The compression springs 25 raise the block 19 toward the fixing roller 12 as the fixing pressure is removed. This removal of the fixing pressure will be described later.

The pressure application unit 13 is supported by a pair of lateral plates 14 (pressure applying means), which are pivotally movable about an axle 15. The lateral plates 14 keep the pressure application unit 13 pressured toward the fixing roller 12 by being kept pressured by fixing springs 17 (pressure applying means). The lateral plates 14 are located at the lengthwise ends of the pressure application unit 13, one for one. In other words, the pressure application unit 13 is structured so that not only can it be made to keep the belt 27 pressured upon the fixing roller 12, but also, it can be made not to pressure the belt 27 upon the fixing roller 12.

The fixings springs 17 are strong springs, which are strong enough to generate roughly 500 N of pressure in the fixing nip. They are for forming the fixing nip, and are adjustable in pressure by an adjustment screw 16 to adjust the internal pressure of the fixing nip to a desired value.

The fixing roller 12 is made up of a cylindrical metallic core, an elastic layer coated on the peripheral surface of the metallic core, and a release layer, as a surface layer, coated on the elastic layer. The metallic core is formed of iron (SUS), aluminum, or the like, and has a thin wall (roughly 1 mm thick). The elastic layer is formed of silicon rubber or the like, and is roughly 0.5 mm in thickness. The release layer is formed of PFA or the like, and is roughly 30 μm in thickness. Within the hollow of the fixing roller 12, a halogen lamp (unshown) is disposed as a heat source, which is controlled in temperature so that the temperature of the fixing roller 12 remains in the adjacencies of 200 degrees.

The belt 27 is formed of polyimide or the like resin, and is roughly 90 μm in thickness. It is provided with a roughly 30 μm thick release layer formed of PFA or the like.

The fixing pad 20 is a first pressure applying portion, which keep the belt 27 pressured toward the fixing roller 12, and is relatively low in hardness; its hardness is in the range of 15-40 degrees in the rubber hardness scale (HS). The pad 20 is formed of such heat resistant rubber that is capable of withstanding a temperature of roughly 200° so that the pad 20 can satisfactorily performs at this level of temperature. It is integrally attached to a base 21 through the molding process used to form the pad 20.

Since the hardness of the fixing pad 20 is in the abovementioned low range, it is easy for the fixing pad 20 to elastically deform. Therefore, as it is pressured against the fixing roller 12, it generates relatively low pressure (P1, which will be described later) across the contact area between itself and fixing roller 12, perfectly conforming to the curvature of the fixing roller 12. Further, for the purpose of preventing the pressure applied to the fixing pad 20 to keep the belt 27 pressed upon the fixing roller 12 from the inward side of the belt loop, from escaping, the fixing pad 20 is shaped so that its belt contacting surface matches in shape the peripheral surface of the fixing roller 12.

The fixing pad 20 is with a surface layer formed of fluorinated latex film to improve the fixing pad 20 in terms of the slipperiness relative to the belt 27. Incidentally, providing the fixing pad 20 with the surface layer formed of fluorinated latex prevents the silicon oil from seeping into the rubber portion of the fixing pad 20, preventing thereby the rubber portion from being made to swell by the silicon oil. Further, providing the fixing pad 20 with the surface layer formed of fluorinated latex improves the fixing pad 20 in terms of the slipperiness relative to the lateral surface 19*a* of the block 19.

A pad mount 26, which supports the fixing pad 20 and base 21, is provided with a guide 29 (FIG. 3), being rendered slidable in the direction to remove the pressure applied to the fixing pad 20. As the pressure application unit 13 is moved into the position in which it does not apply pressure to the fixing roller 12, the pad mount 26 is pressured upward, that is, toward the fixing roller 12, by the compression springs 24. However, the movement of the pad mount 26 toward the fixing roller 12 is regulated by a stopper 30.

The block 19 is disposed in contact with the fixing pad 20. It is a second pressure applying member which generates higher pressure in the fixing nip than the pressure which the fixing pad 20 generated in the fixing nip. The block 19 is formed of a metallic substance such as aluminum, stainless steel, or the like, and is preferred to be formed in a single-piece. The metallic surface of the block 19 may be covered with resin such as liquid polymer that is highly rigid and highly heat resistant. In particular, the high rigidity block 19 (high rigidity pad) is required to remain sufficiently rigid and hard even at the fixing temperature (roughly 200° C.). Therefore, when aluminum alloy (#5,000), for example, is used as the material for the block 19, an aluminum alloy, the hardness of which is greater than 60 HB (in the case of stainless steel, no less than 100 HB) is selected to ensure that the high pressure (P3 which will be described later) can be generated. In order to ensure the generation of P3, the metallic material for the block 19 is required of the above described level of rigidity. In other words, the block 19 is harder than the fixing pad 20.

Figure 7:
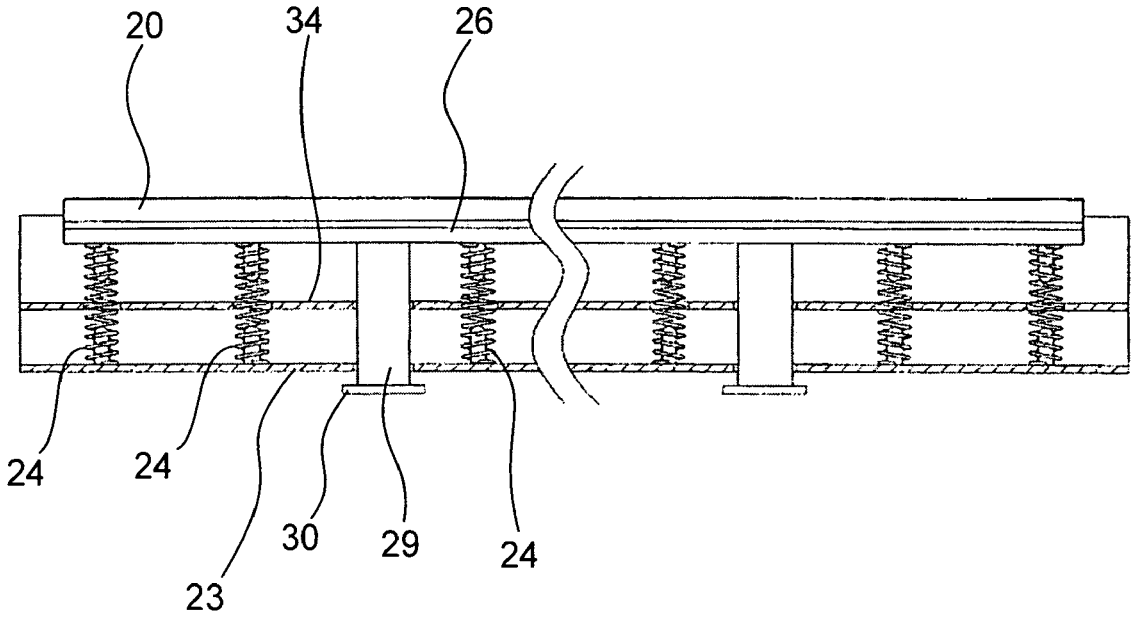
FIG. 7 is a side view of the fixing pad, and its adjacencies, in the preferred embodiment.
Figure 8:
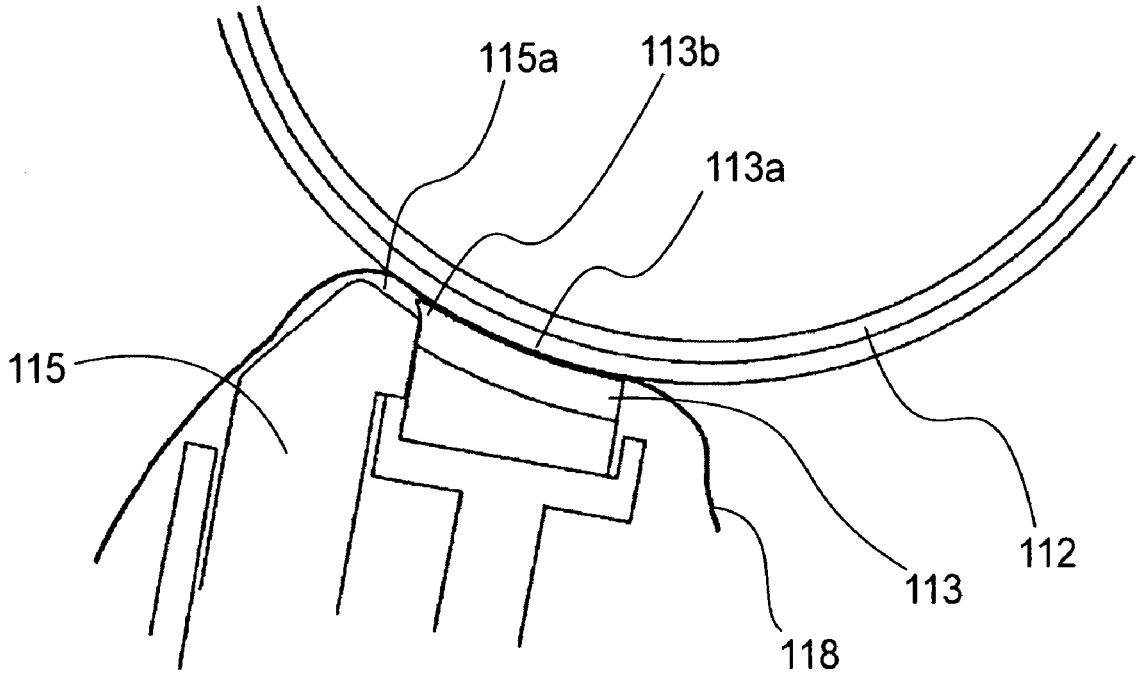
FIG. 8 is a sectional view of the essential portions of the fixing apparatus in accordance with the prior art.

FIG. 7 is a side view of the fixing pad 20. As described above, the pressure application unit 13 is provided with the multiple compression springs 24, which are aligned in parallel in the lengthwise direction which is parallel to the lengthwise direction of the fixing pad 20, with preset intervals, so that the pressure applied to the fixing pad 20 by the compression springs 24 becomes uniform in distribution in terms of the lengthwise direction of the fixing pad 20. The two sets of guide 29 and stopper 30 are disposed at two locations, one for one, in terms of the lengthwise direction of the fixing pad 20, so that the fixing pad 20 is kept stable in attitude when the pressure is removed.

Figure 6:
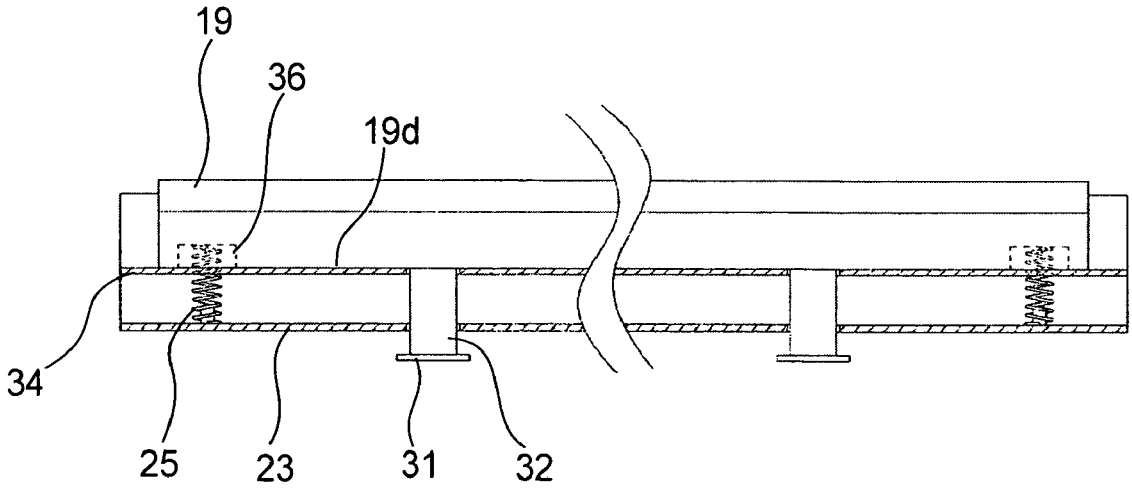
FIG. 6 is a side view of the high rigidity block, and its adjacencies, in the preferred embodiment.

FIG. 6 is a side view of the high rigidity block 19. The block 19 is provided with a pair of recesses 36, which are located in the lengthwise end portions of the block 19, one for one, and in which one end of the compression spring 25 is fitted. The block 19 is also provided with a pair of guides 32, which are integral parts of the block 19, enabling the block 19 to slide independently from the fixing pad 20. The stopper 31 regulates the movement of the block 19 in the pressure applying direction. The only role which the compression springs 25 play is to lift the block 19 when the pressure is removed. While the fixing pressure is applied, the bottom surface 19*d* of the block 19 remains in contact with the top surface of the member 34. Therefore, the block 19 bears the pressure from the fixing springs 17, through the stay 23.

In other words, according to this embodiment, when the pressure application unit 13 is in such a state that the fixing springs 17 keep the belt 27 pressed upon the fixing roller 12, the fixing pad 20 generates the aforementioned low pressure by being pressured by the compression springs 24 through the stay 23, and the block 19 is pressured by the stay 23. Therefore, the block 19, which is required to generate the pressure higher than the pressure generated by the fixing pad 20, can be pressured by stronger fixing springs which are located outside the pressure application unit 13, being thereby enabled to apply the higher pressure. Therefore, the pressure application unit 13 can be reduced in size.

The fixing nip formed between the fixing roller 12 and belt 27 has the low pressure portion, that is, the portion which is relatively low in internal pressure, which is formed by the fixing pad 20, and the high pressure portion, that is, the portion which is relatively high in internal pressure, which is formed by the block 19. Further, the low and high pressure portions are contiguous. In other words, the pressure application unit 13 is structured so that, in terms of the recording medium conveyance direction, the internal pressure of the fixing nip is lowest at the upstream end, and also, so that the closer to the downstream end, the higher the internal pressure, being at its peak near the downstream end. It should be noted here that for the purpose of forming a wide nip within a limited space, it is effective to employ a fixing pad to apply fixing pressure to form a fixing nip.

In this embodiment, a wider nip is formed by pressuring the fixing pad 20 against the fixing roller 12 with the belt 27 pinched between the fixing pad 20 and fixing roller 12. This type of structural arrangement causes the entirety of the fixing roller facing surface of the fixing pad 20 to be pressed against the fixing roller 12, making it possible to form a wider fixing nip while minimizing the space necessary to form the nip.

Figure 9:
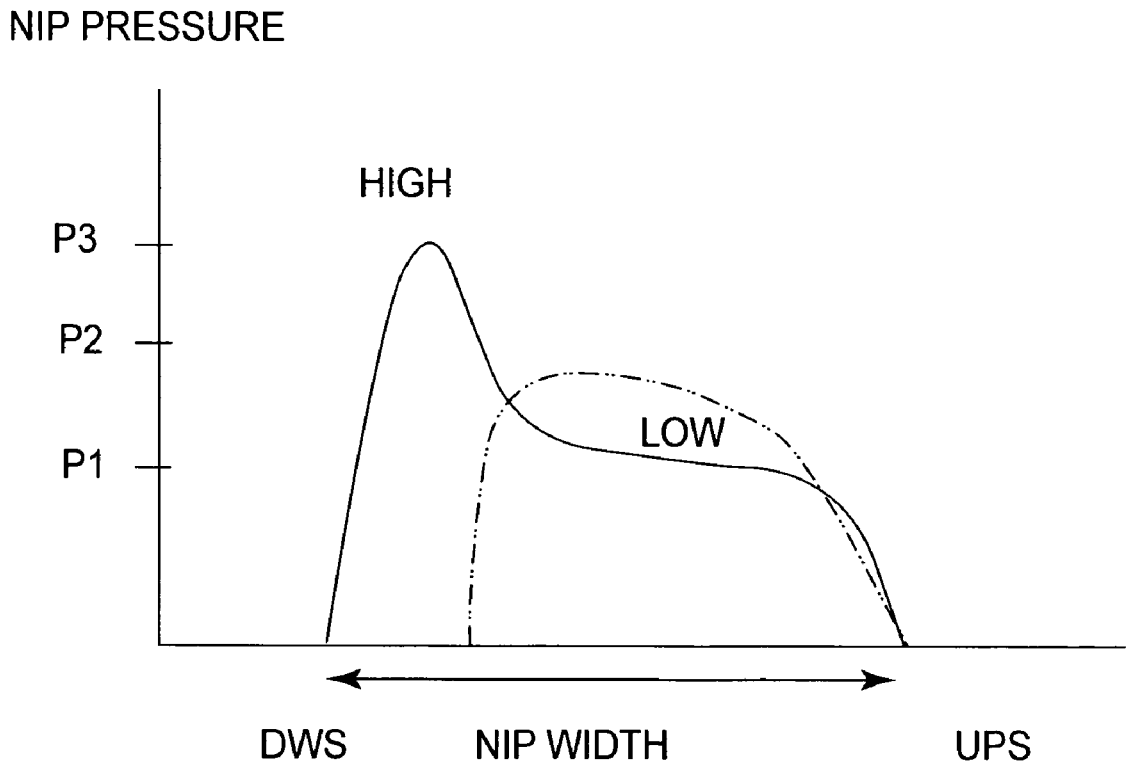
FIG. 9 is a graph schematically showing the nip pressure distribution of the image heating apparatus.

FIG. 9 is a graph schematically showing the pressure distribution in the fixing nip of the image heating apparatus. The axis of abscissas represents the position in the fixing nip in terms of the recording medium conveyance direction, and the axis of ordinates represents the internal pressure of the fixing nip at a given point. The solid line represents the ideal distribution pattern for the internal pressure of the fixing nip. In other words, the distribution of the internal pressure of the fixing nip is desired to be such that the internal pressure is no lower than the low pressure P1 (0.05-0.2 MPa) and no higher than the high pressure P3 (0.3-0.5 MPa), and also, such that the closer to the exit of the fixing nip, the higher the internal pressure of the fixing nip, for the following reason. That is, if a given portion of the fixing nip, in terms of the recording medium conveyance direction, is lower in internal pressure than the upstream portion, the pressure applied to the recording medium to fix the toner images temporarily falls while the recording medium is conveyed through the fixing nip. Consequently, a copy suffering from image deviation and/or non-uniformity in glossiness is yielded. Incidentally, one pascal is the SI unit of pressure equal to one newton per square meter.

The heating of the toner images on the recording medium begins at the entrance of the fixing nip, and the heating temperature is highest at the exit of the nip. Applying high pressure while the toner is in the fully melted condition is an effective pressure application method for better fixation. The pressure P2 (roughly 0.2 MPa) is the amount of pressure necessary to cause the recording medium S to separate from the fixing roller 12, that is, the amount of pressure necessary for the high rigidity block 19 to partially deform the rubber layer of the fixing roller 12. Therefore, in order to enable the image heating apparatus in this embodiment to display the above described image fixing performance, the apparatus is structured so that its fixing nip is provided with the low pressure portion and high pressure portions, which are contiguous.

If the recording medium S becomes stuck at the fixing unit 11, an unshown lever is to be rotated to eliminate the fixing nip, in order to make it possible for the recording medium S to be removed. The rotation of the lever causes the pair of lateral plates 14 to rotate in the direction opposite to the direction in which the plates 14 are rotated for the pressure application. As a result, the fixing nip is eliminated against the force generated by the fixing springs 17.

Figure 3:
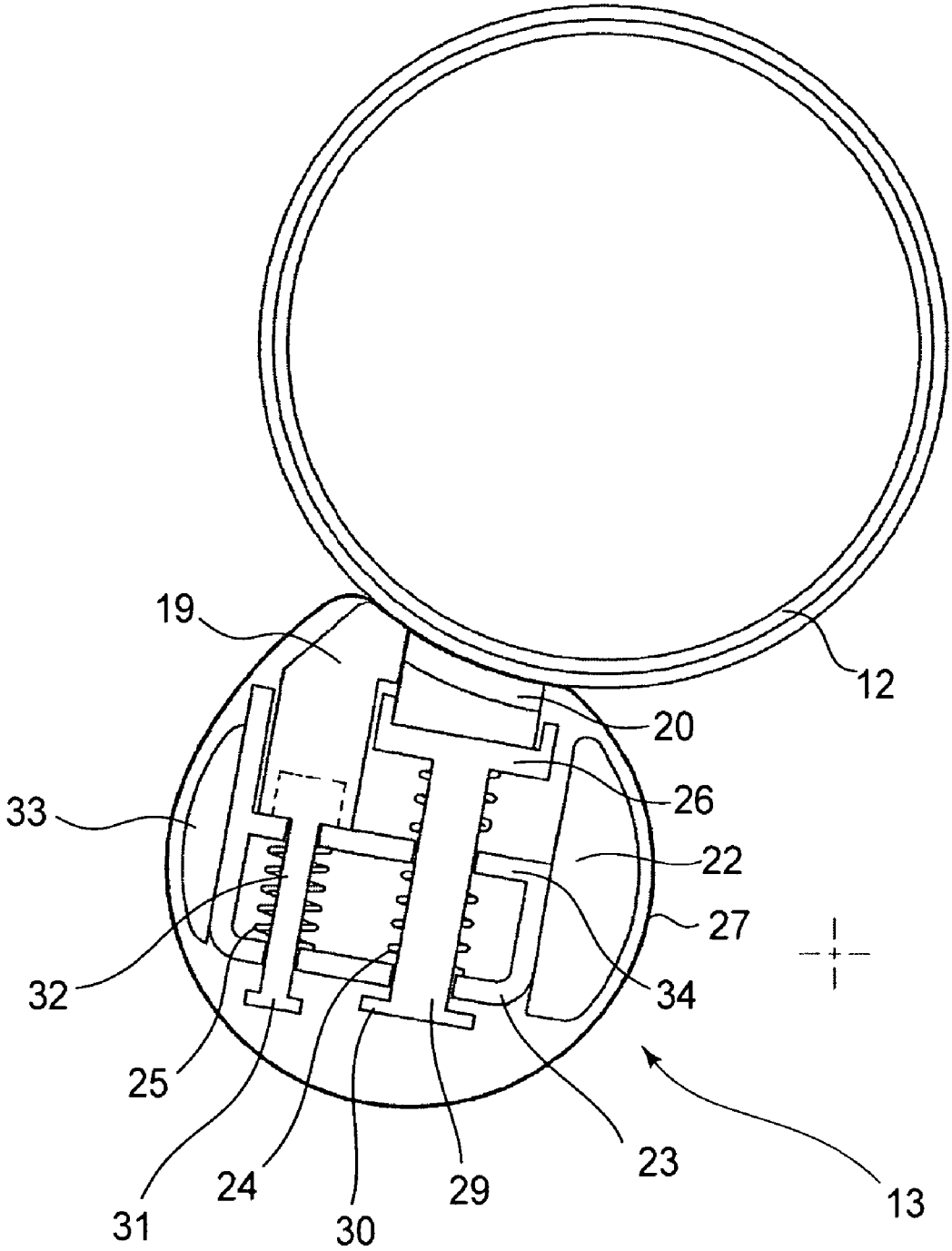
FIG. 3 is a sectional view of the pressure application unit and fixing roller in the preferred embodiment.
Figure 4:
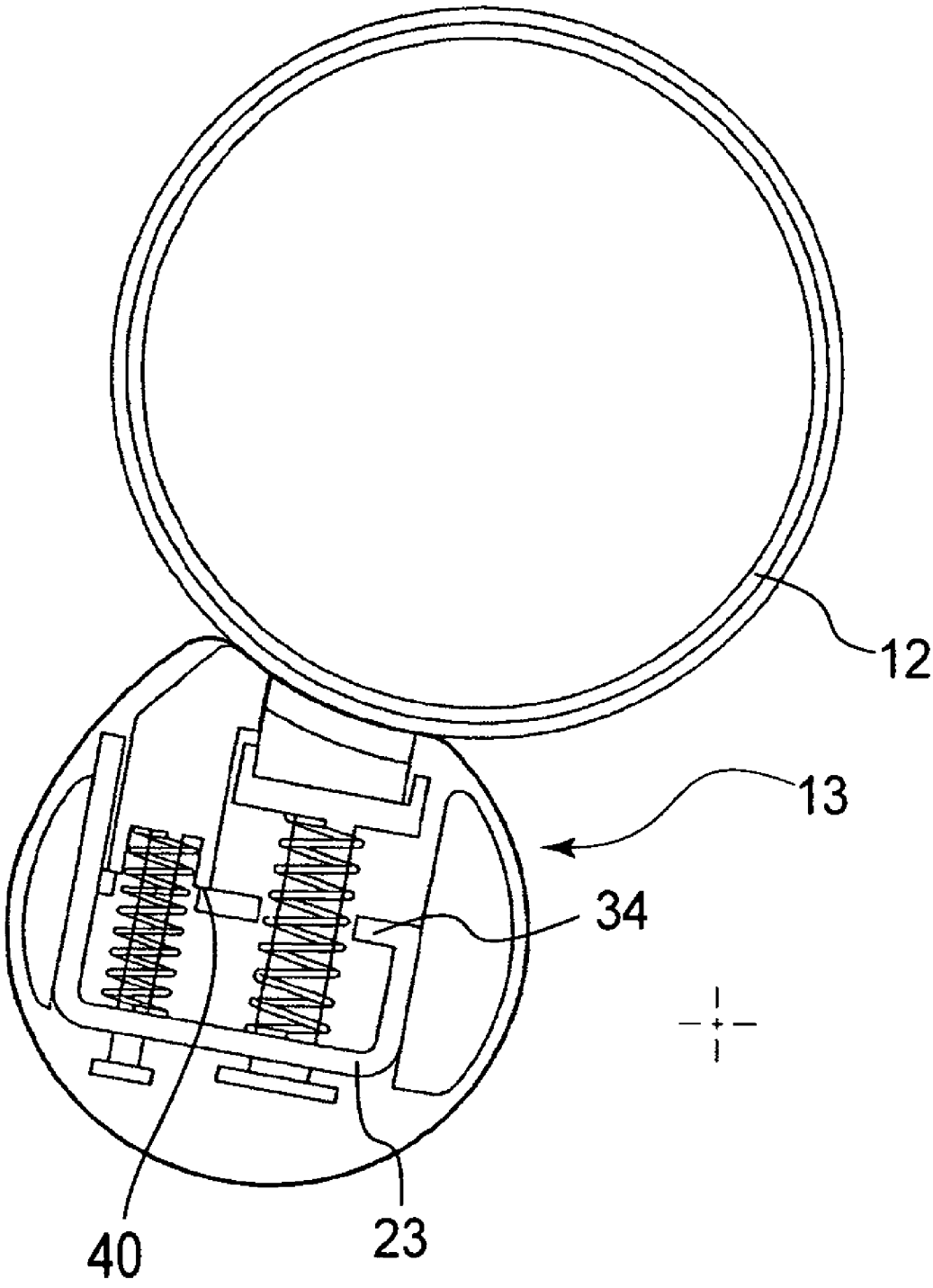
FIG. 4 is a sectional view of the fixing roller, and the pressure application unit kept pressed against the fixing roller, in the preferred embodiment.

FIGS. 3 and 4 are sectional views of the fixing roller 12, and the pressure application unit 13 kept pressed against the fixing roller 12. The two drawings are different in the position of sectional plane, in terms of the lengthwise direction of the pressure application unit 13.

The block 19 forms the high pressure portion of the fixing nip by being pressed against the fixing roller 12 by the fixing springs 17, which pressures the entirety of the pressure application unit 13, through the stay 23. The compression springs 25 are compressed by the force generated by the fixing springs 17, so that the bottom surface 19*d* of the block 19 comes into contact with the top surface of the member 34 of the stay 23. With the bottom surface 19*d* remaining in contact with the stay 23, the high pressure portion of the fixation remains stable in internal pressure. As for the fixing pad 20, it is made to form the low pressure portion of the fixing nip, by being pressured by the compression springs 24.

Figure 5:
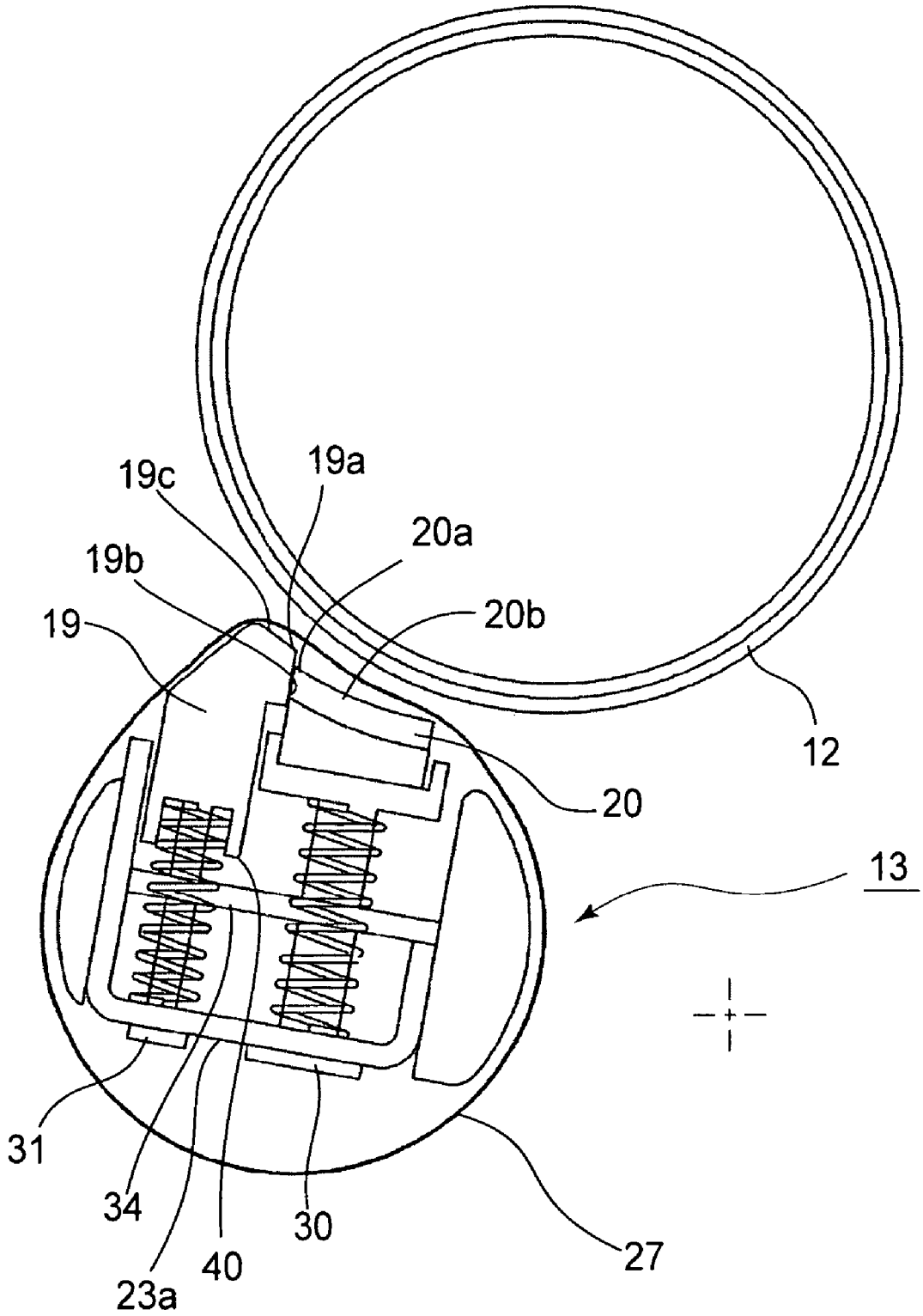
FIG. 5 is a sectional view of the fixing roller, and the pressure application unit separated from the fixing roller.

FIG. 5 is a sectional view of the fixing roller, and the pressure application unit which is not being pressed against the fixing roller. The fixing nip is eliminated by separating the pressure application unit 13 from the fixing roller 12. Incidentally, as long as the image heating apparatus is structured to allow the jammed recording medium S to be easily pulled out, it does not need to be structured to allow the pressure application unit 13 to be completely separated from the fixing roller 12. As the pressure application unit 13 is separated from the fixing roller 12, the fixing pad 20, which is on the inward side of the belt loop, is moved upward by the pressure from the compression springs 24, causing the stopper 30 of the pad mount 26 to come into contact with the bottom surface 23*a* of the stay 23. At the same time, the block 19 is moved upward by the pressure from the compression springs 25, causing the stopper 31, which is an integral part of the block 19, to come into contact with the bottom surface 23*a* of the stay 23.

As for the positional relationship between the leading edge portion 20*a* of the fixing pad 20 and the edge 19*b* of the block 19, the edge 19*b* remains positioned higher than the leading edge portion 20*a*; the fixing pad 20 never protrudes above the block 19. That is, the belt contacting surface 20*b* of the fixing pad 20, as the first pressure application surface, by which the fixing pad 20 presses the belt 27, the belt contacting surface 19*c* of the block 19, as the second pressure application surface, by which the block 19 presses the belt 27, are positioned next to each other, with the presence of a step between the two belt contacting surfaces 20*b* and 19*c*. Thus, after the removal of the pressure applied to the belt 27, the belt contacting surface 19*c* of the block 19 is closer to the fixing roller 12 than the belt contacting surface 20*b* of the fixing pad 20. In other words, the pressure application unit 13 is structured so that when pressure is applied to the belt 27, the block 19 comes into contact with the belt 27 before the fixing pad 20. Therefore, when the pressure application unit 13 is moved from the position in which it is not pressed against the fixing roller 12, to the position in which it is pressed against the fixing roller 12, the belt contacting surface 19*c* of the block 19 begins to press the belt 27 toward the fixing roller 12 before the belt contacting surface 20 of the fixing pad 20 does. Then, the belt contacting surface 20*b* of the fixing pad 20 begins to press the belt 27 toward the fixing roller 12 to complete the fixing nip.

Therefore, the above described problem which an image heating apparatus in accordance with the prior art suffers, that is, the problem that the leading edge portion 20*a* of the fixing pad 20 is pinched by the block 19, does not occur. Therefore, each time the pressure applying operation is carried out, a pressure nip which is identical to the desired fixing nip, which was initially formed, is formed, regardless of the number of times the combination of the pressure removing operation and pressure applying operation is carried out. In other words, the present invention is effective to improve an image heating apparatus in terms of image fixing performance endurance. Further, the present invention prevents the leading edge portion 20*a* of the fixing pad 20 from being subjected to an excessive amount of pressure, preventing thereby the coating of the fixing pad 20 from peeling. In other words, the present invention extends the service life of the fixing pad 20; it can prevent the problem that the amount of pressure which the fixing pad 20 generates is changed by the swelling of the fixing pad 20, which is caused by the silicon oil.

Further, as the pressure application unit 13 is moved from the position in which it is not pressed against on the fixing roller 12, to the position in which it is pressed against the fixing roller 12, the block 19, which is harder than the fixing pad 20 and generates higher pressure than the fixing pad 20, begins to generate pressure before the fixing pad 20, which is softer than the block 19 and generates low pressure than the block 19 applies, does. Therefore, the problem that the fixing pad 20, which is softer than the block 19, is partially pinched between the block 19 and belt 27 does not occur. Therefore, the problem that the desired fixing is not reproduced does not occur. Further, it does not occur that a part or parts of the fixing pad 20 is subjected to an excessive amount of pressure. Therefore, the fixing pad 20 does not deform nor break. In other words, the present invention is effective to extend the service life of an image heating apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 142419/2005 filed May 16, 2005 which is hereby incorporated by reference.

What is claimed is:

1. An image heating apparatus comprising:

a heating rotatable member configured to heat an image on a recording material at a nip;

an endless belt cooperative with said heating rotatable member to form the nip;

an elastic pad and a rigid pad, disposed in the order named along a feeding direction for the recording material, configured with surfaces to press said endless belt toward said heating rotatable member at the nip, with a pressure, per unit area, of said rigid pad to said endless belt being higher than a pressure, per unit area, of said elastic pad to said endless belt; and a moving device configured to move said elastic pad and said rigid pad between (i) a pressing position where said elastic pad and rigid pad press said endless belt toward said heating rotatable member at the nip and (ii) a separating position where said elastic pad and rigid pad separate said endless belt from said heating rotatable member at the nip, wherein said moving device includes a first spring configured to urge said elastic pad toward said endless belt and a second spring configured to urge said rigid pad toward said endless belt; and wherein a distance between a surface of said elastic pad that presses said endless belt and a surface of said rigid pad that presses said endless belt at the separating position is greater than a distance between said surfaces at the pressing position so that a pressing operation of said rigid pad starts earlier than a pressing operation of said elastic pad when said moving device moves said elastic pad and said rigid pad from said separating position to said pressing position.

2. An apparatus according to claim 1, wherein said elastic pad comprises rubber, and said rigid pad comprises metal or resin material.

3. An apparatus according to claim 2, wherein said elastic pad has a hardness of 15-40 HS, and said rigid pad has a hardness not less than 60 HB.

* * * * *